US009966081B2

(12) United States Patent
Jeong et al.

(10) Patent No.: US 9,966,081 B2
(45) Date of Patent: May 8, 2018

(54) METHOD AND APPARATUS FOR SYNTHESIZING SEPARATED SOUND SOURCE

(71) Applicant: Electronics and Telecommunications Research Institute, Daejeon (KR)

(72) Inventors: Young Ho Jeong, Daejeon (KR); Tae Jin Lee, Daejeon (KR); Dae Young Jang, Daejeon (KR); Jin Soo Choi, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days. days.

(21) Appl. No.: 15/288,033

(22) Filed: Oct. 7, 2016

(65) Prior Publication Data

US 2017/0251319 A1 Aug. 31, 2017

(30) Foreign Application Priority Data

Feb. 29, 2016 (KR) ..... 10-2016-0024397

(51) Int. Cl.

| | |
|---|---|
| ***H04R 5/00*** | (2006.01) |
| ***G10L 19/022*** | (2013.01) |
| ***G10L 21/028*** | (2013.01) |
| *G10L 19/008* | (2013.01) |

(52) U.S. Cl.

CPC ..... *G10L 19/022* (2013.01); *G10L 21/028* (2013.01); *G10L 19/008* (2013.01); *H04S 2400/15* (2013.01)

(58) Field of Classification Search

CPC .. H04S 1/007; H04S 2400/11; H04S 2400/15; G10L 19/008; G10L 19/022

USPC ..... 381/17

See application file for complete search history.

(56) References Cited

U.S. PATENT DOCUMENTS

| | | | | |
|---|---|---|---|---|
| 2009/0060207 | A1* | 3/2009 | Barry | H04R 5/04 381/17 |
| 2010/0215199 | A1* | 8/2010 | Breebaart | H04S 5/005 381/310 |
| 2012/0093341 | A1 | 4/2012 | Kim et al. | |
| 2013/0016842 | A1* | 1/2013 | Schultz-Amling | G10L 19/173 381/17 |

(Continued)

FOREIGN PATENT DOCUMENTS

KR 10-2011-0053600 A 5/2011

OTHER PUBLICATIONS

Heeger, Auditory pathways and sound localization, p. 7.*

(Continued)

*Primary Examiner* — William A Jerez Lora
(74) *Attorney, Agent, or Firm* — NSIP Law

(57) ABSTRACT

Provided is a method and apparatus for synthesizing a separated sound source, the method including generating spatial information associated with a sound source included in a frame of a stereo audio signal, and synthesizing a separated frequency-domain sound source from the frame of the stereo audio signal based on the spatial information, wherein the spatial information includes a frequency-azimuth plane representing an energy distribution corresponding to a frequency and an azimuth of the frame of the stereo audio signal.

8 Claims, 7 Drawing Sheets

(56) References Cited

U.S. PATENT DOCUMENTS

| | | | | |
|---|---|---|---|---|
| 2014/0270226 | A1* | 9/2014 | Borgstrom | G10L 17/00 381/71.11 |
| 2015/0063574 | A1 | 3/2015 | Choi et al. | |

OTHER PUBLICATIONS

Dan Barry, et al., "Sound Source Separation: Azimuth Discrimination and Resynthesis," *Proceedings of the 7th International Conference on Digital Audio Effects*, DAFX '04, Naples, Italy, Oct. 5-8, 2004 (6 pages, in English).

Youngho Jeong, et al., "New Separated Sound Source Synthesis based on ADRess Algorithm," *Proceedings of The Korean Institute of Broadcast and Media Engineers*, Nov. 6, 2015 (1 page in English, 10 pages in Korean).

* cited by examiner

METHOD AND APPARATUS FOR SYNTHESIZING SEPARATED SOUND SOURCE

CROSS-REFERENCE TO RELATED APPLICATION(S)

This application claims the priority benefit of Korean Patent Application No. 10-2016-0024397 filed on Feb. 29, 2016, in the Korean Intellectual Property Office, the disclosure of which is incorporated herein by reference for all purposes.

BACKGROUND

1. Field

One or more example embodiments relate to a method and apparatus for processing a stereo audio signal, and more particularly, to a method and apparatus for synthesizing a separated sound source from a stereo audio signal.

2. Description of Related Art

In general, a human has two ears on a left side and a right side of a head. A human perceives a spatial position of a sound source that produces a sound based on an inter-aural intensity difference (IID) which represents a difference between a sound input into the left ear and a sound input into the right ear.

A stereo audio signal includes a left channel signal and a right channel signal. Technology for synthesizing a separated sound source obtains spatial information of a plurality of sound sources mixed in the stereo audio signal using the hearing characteristic of a human, and synthesizes separated sound sources based on the spatial information. The technology for synthesizing a separated sound source may be utilized in various fields of application such as an object-based audio service, a music information search service, and multi-channel upmixing.

An example of the technology for synthesizing a separated sound source is an azimuth discrimination and resynthesis (ADRess) algorithm. The ADRess algorithm establishes an azimuth axis of a frequency-azimuth plane based on a ratio of the left channel signal to the right channel signal, rather than an actual azimuth.

SUMMARY

An aspect provides a method and apparatus for synthesizing a separated sound source that may identify an actual azimuth of a sound source accurately.

Another aspect also provides a method and apparatus for synthesizing a separated sound source that may apply a probability density function to a dominant signal between a left channel signal and a right channel signal, thereby improving a quality of sound.

According to an aspect, there is provided a separated sound source synthesizing method including generating spatial information associated with a sound source included in a frame of a stereo audio signal, and synthesizing a separated frequency-domain sound source from the frame of the stereo audio signal based on the spatial information. The spatial information may include a frequency-azimuth plane representing an energy distribution corresponding to a frequency and an azimuth of the frame of the stereo audio signal.

The generating may include determining a signal intensity ratio of a frequency component of a left channel signal to a frequency component of a right channel signal based on a magnitude difference between the frequency component of the left channel signal and the frequency component of the right channel signal, the left channel signal and the right channel signal constituting the frame of the stereo audio signal, obtaining an azimuth corresponding to the signal intensity ratio, and generating the frequency-azimuth plane by estimating an amount of energy of the sound source at the azimuth that minimizes the magnitude difference between the frequency component of the left channel signal and the frequency component of the right channel signal.

The synthesizing may include calculating the energy distribution of the frame of the stereo audio signal corresponding to the azimuth by accumulating an amount of energy of a frequency component for each azimuth in the frequency-azimuth plane, identifying an azimuth of the sound source by identifying the azimuth at which an amount of energy is at a local maximum in the energy distribution of the frame of the stereo audio signal corresponding to the azimuth, determining a probability density function based on a signal intensity ratio corresponding to the azimuth of the sound source, and extracting the separated sound source by applying the probability density function to a dominant signal between a left channel signal and a right channel signal constituting the frame of the stereo audio signal.

The probability density function may be a Gaussian window function, and an axis of symmetry of the Gaussian window function may be determined based on the azimuth of the sound source.

The synthesizing may include transforming the separated frequency-domain sound source into a separated time-domain sound source, and applying an overlap-add technique to the separated time-domain sound source.

According to another aspect, there is also provided a frequency-azimuth plane generating method including determining a signal intensity ratio of a frequency component of a left channel signal to a frequency component of a right channel signal based on a magnitude difference between the frequency component of the right channel signal and the frequency component of the right channel signal, the left channel signal and the right channel signal constituting a frame of a stereo audio signal, obtaining an azimuth corresponding to the signal intensity ratio, and generating a frequency-azimuth plane by estimating an amount of energy of a sound source included in the stereo audio signal at the azimuth that minimizes the magnitude difference between the frequency component of the left channel signal and the frequency component of the right channel signal.

The frequency-azimuth plane generating method may further include calculating an energy distribution of the stereo audio signal corresponding to the azimuth by accumulating an amount of energy of a frequency component for each azimuth in the frequency-azimuth plane, and identifying an azimuth of the sound source by identifying the azimuth at which an amount of energy of the stereo audio signal is at a local maximum in the energy distribution.

The identifying of the azimuth of the sound source may include identifying azimuths at which the amount of the energy of the stereo audio signal is at the local maximum, and a number of the azimuths may correspond to a number of sound sources.

According to yet another aspect, there is also provided a separated sound source synthesizing apparatus including a spatial information generator configured to generate spatial information associated with a sound source included in a frame of a stereo audio signal, and a separated sound source synthesizer configured to synthesize a separated frequency-domain sound source from the frame of the stereo audio signal based on the spatial information. The spatial information may include a frequency-azimuth plane representing an energy distribution corresponding to a frequency and an azimuth of the frame of the stereo audio signal.

According to an example embodiment, a method and apparatus for synthesizing a separated sound source may identify an actual azimuth of a sound source accurately.

According to an example embodiment, a method and apparatus for synthesizing a separated sound source may apply a probability density function to a dominant signal between a left channel signal and a right channel signal, thereby improving a quality of sound.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
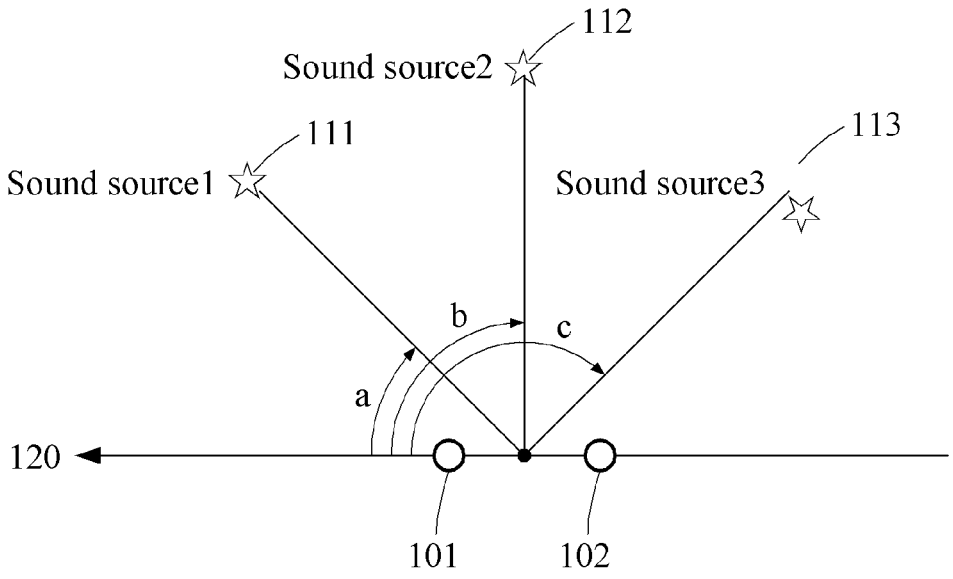
FIG. 1 is a diagram illustrating spatial positions of sound sources included in a stereo audio signal according to an example embodiment.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Specific structural or functional descriptions of example embodiments are merely disclosed as examples, and may be variously modified and implemented. Thus, the example embodiments are not limited, and it is intended that various modifications, equivalents, and alternatives are also covered within the scope of the present disclosure.

Though the present disclosure may be variously modified and have several embodiments, specific embodiments will be shown in drawings and be explained in detail. However, the present disclosure is not meant to be limited, but it is intended that various modifications, equivalents, and alternatives are also covered within the scope of the claims.

Although terms of "first", "second", etc. are used to explain various components, the components are not limited to such terms. These terms are used only to distinguish one component from another component. For example, a first component may be referred to as a second component, or similarly, the second component may be referred to as the first component.

When it is mentioned that one component is "connected" or "accessed" to another component, it may be understood that the one component is directly connected or accessed to another component or that still other component is interposed between the two components.

A singular expression includes a plural concept unless there is a contextually distinctive difference therebetween. Herein, the term "include" or "have" is intended to indicate that characteristics, numbers, steps, operations, components, elements, etc. disclosed in the specification or combinations thereof exist. As such, the term "include" or "have" should be understood that there are additional possibilities of one or more other characteristics, numbers, steps, operations, components, elements or combinations thereof.

Unless specifically defined, all the terms used herein including technical or scientific terms have the same meaning as terms generally understood by those skilled in the art. Terms defined in a general dictionary should be understood so as to have the same meanings as contextual meanings of the related art. Unless definitely defined herein, the terms are not interpreted as ideal or excessively formal meanings.

Hereinafter, example embodiments will be described in detail with reference to the accompanying drawings. Like reference numerals in the drawings denote like elements.

FIG. 1 is a diagram illustrating spatial positions of sound sources included in a stereo audio signal according to an example embodiment.

Referring to FIG. 1, a left channel microphone 101 configured to record a left channel signal of a stereo audio signal, and a right channel microphone 102 configured to record a right channel signal of the stereo audio signal are illustrated. The left channel microphone 101 and the right channel microphone 102 may be included in a stereo microphone.

A sound source 1 111, a sound source 2 112, and a sound source 3 113 that produce sounds may be disposed at difference positions. The left channel microphone 101 and the right channel microphone 102 may record the sounds simultaneously produced by the sound source 1 111, the sound source 2 112, and the sound source 3 113. Thus, the sound source 1 111, the sound source 2 112, and the sound source 3 113 may be mixed in the single stereo audio signal.

The term "separated sound source" refers to a sound source restored from the stereo audio signal by a separated sound source synthesizing apparatus. The separated sound source synthesizing apparatus may synthesize a separated sound source based on a difference between the left channel signal and the right channel signal of the stereo audio signal. The separated sound source synthesizing apparatus may obtain spatial information of a sound source from the stereo audio signal. The separated sound source synthesizing apparatus may synthesize the separated sound source based on the obtained spatial information.

The sound source 1 111, the sound source 2 112, and the sound source 3 113 may have different azimuths based on a reference axis 120 on which the left channel microphone 101 and the right channel microphone 102 are disposed. As shown in FIG. 1, the sound source 1 111 may have a least azimuth a, and the sound source 3 113 may have a greatest azimuth c. As the azimuth decreases, a distance between a sound source and the right channel microphone 102 may increase and a distance between a sound source and the left channel microphone 101 may decrease.

A sound may be attenuated in proportion to a distance from a sound source. In a case in which the sound source is at different distances from the left channel microphone 101 and the right channel microphone 102, the left channel signal recorded through the left channel microphone 101 and the right channel signal recorded through the right channel microphone 102 may differ from each other in terms of magnitude. Referring to FIG. 1, the left channel microphone 101 is closer to the sound source 1 111 than the right channel microphone 102 is, and thus a magnitude of a left channel signal with respect to the sound source 1 111 may be greater than a magnitude of a right channel signal with respect to the sound source 1 111. Further, the left channel microphone 101 is more distant from the sound source 3 113 than the right channel microphone 102 is, and thus a magnitude of a left channel signal with respect to the sound source 3 113 may be less than a magnitude of a right channel signal with respect to the sound source 3 113.

According to an example embodiment, the separated sound source synthesizing apparatus may identify an azimuth of a sound source based on a magnitude difference between a frequency component of a left channel signal and a frequency component of a right channel signal. The separated sound source synthesizing apparatus may synthesize a separated sound source with respect to the sound source from a stereo audio signal based on the identified azimuth of the sound source.

Figure 2:
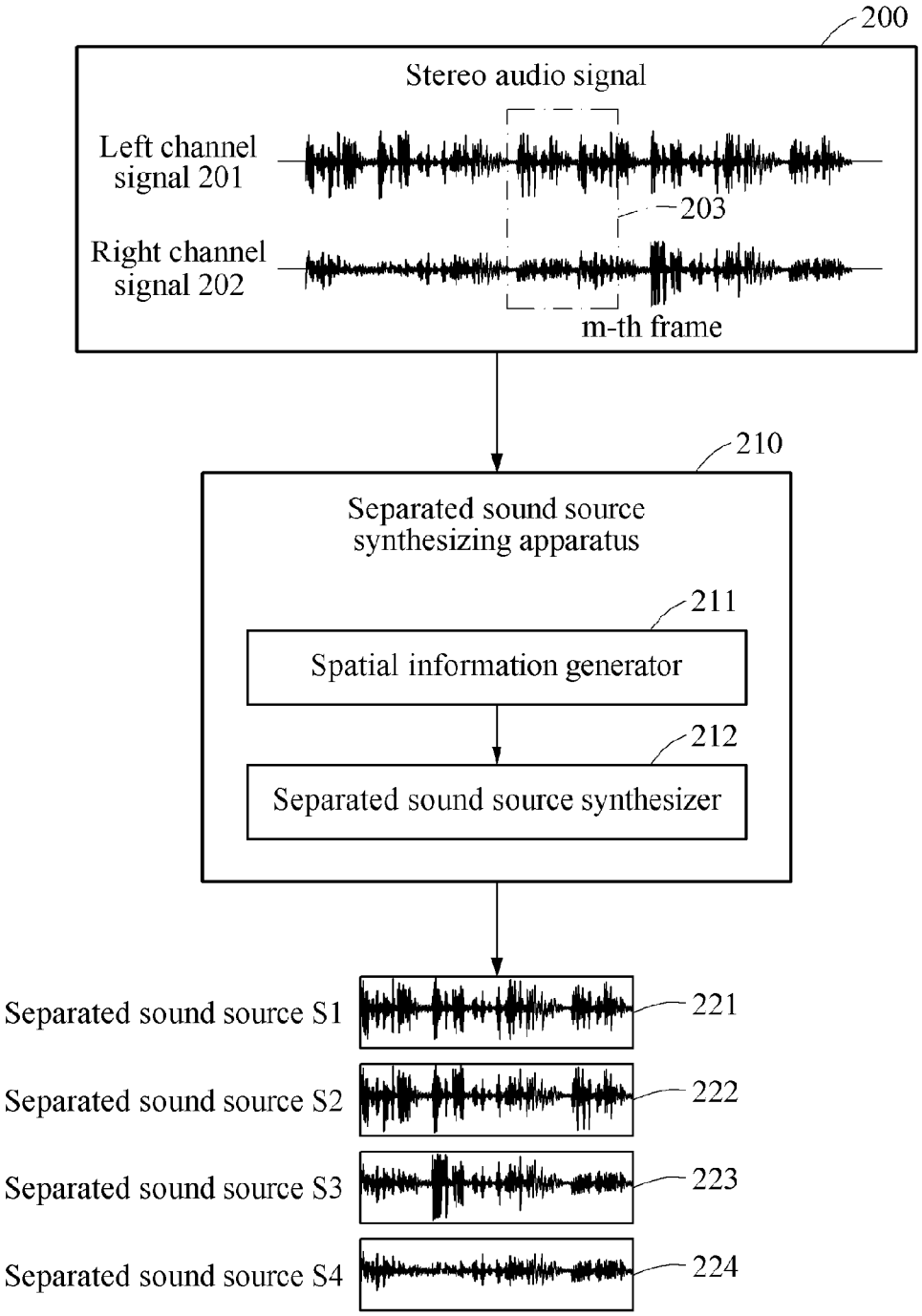
FIG. 2 is a diagram illustrating a structure of a separated sound source synthesizing apparatus according to an example embodiment.

FIG. 2 is a diagram illustrating a structure of a separated sound source synthesizing apparatus according to an example embodiment.

Referring to FIG. 2, a stereo audio signal 200 includes a left channel signal 201 and a right channel signal 202. A separated sound source synthesizing apparatus 210 may generate spatial information associated with a sound source included in the stereo audio signal 200.

The separated sound source synthesizing apparatus 210 may synthesize a separated sound source from the stereo audio signal 200 based on the spatial information of the sound source. It may be assumed that four sound sources are mixed in the stereo audio signal 200. In this example, the separated sound source synthesizing apparatus 210 may synthesize a separated sound source S1 221, a separated sound source S2 222, a separated sound source S3 223, and a separated sound source S4 224 from the stereo audio signal 200 based on spatial information of each sound source.

The separated sound source synthesizing apparatus 210 may synthesize the separated sound source for each frame of the stereo audio signal 200. Hereinafter, an operation of the separated sound source synthesizing apparatus 210 synthesizing a separated sound source from an m-th frame 203 of the stereo audio signal 200 will be described in detail. The separated sound source synthesizing apparatus 210 may include a spatial information generator 211 configured to generate spatial information of a sound source included in the m-th frame 203. The spatial information generator 211 may transform the m-th frame 203 into a frequency-domain signal. The spatial information generator 211 may transform the m-th frame 203 into the frequency-domain signal using short-time Fourier transform (STFT). The frequency-domain signal transformed from the m-th frame 203 may include a frequency-domain left channel signal and a frequency-domain right channel signal.

The spatial information generated by the spatial information generator 211 may include a frequency-azimuth plane. The spatial information generator 211 may identify, for each frame, an azimuth that minimizes a magnitude difference between a frequency component of the left channel signal and a frequency component of the right channel signal. The spatial information generator 211 may estimate an amount of energy of a predetermined frequency component of the sound source included in the m-th frame 203 at the azimuth. The spatial information generator 211 may generate the frequency-azimuth plane based on the estimated amount of energy.

The frequency-azimuth plane may represent the energy distribution corresponding to a frequency and an azimuth of the m-th frame 203. The spatial information generator 211 may generate the frequency-azimuth plane in a frequency-azimuth space with axes of a frequency and an actual azimuth.

The separated sound source synthesizing apparatus 210 may further include a separated sound source synthesizer 212 configured to synthesize a separated frequency-domain sound source from the m-th frame 203 based on the spatial information. As described above, the spatial information includes the frequency-azimuth plane which is generated based on the actual azimuth. Thus, the separated sound source synthesizer 212 may identify an accurate azimuth of a sound source by analyzing the frequency-azimuth plane.

The separated sound source synthesizer 212 may calculate the energy distribution corresponding to the azimuth of the m-th frame 203 from the frequency-azimuth plane. The energy distribution may be concentrated on the azimuth of the sound source included in the m-th frame 203. The separated sound source synthesizer 212 may identify the azimuth of the sound source by identifying an azimuth at which the energy distribution corresponding to the azimuth of the m-th frame 203 is at a local maximum.

The separated sound source synthesizer 212 may determine a probability density function based on the identified azimuth of the sound source. The probability density function may be a Gaussian window function. The separated sound source synthesizer 212 may obtain the separated frequency-domain sound source by applying the probability density function to a dominant signal between the left channel signal of the m-th frame 203 and the right channel signal of the m-th frame 203. Further, the separated sound source synthesizer 212 may transform the separated frequency-domain sound source into a separated time-domain sound source using inverse short-time Fourier transform (ISTFT). The separated sound source synthesizer 212 may synthesize the separated sound source using an overlap-add technique.

Figure 3:
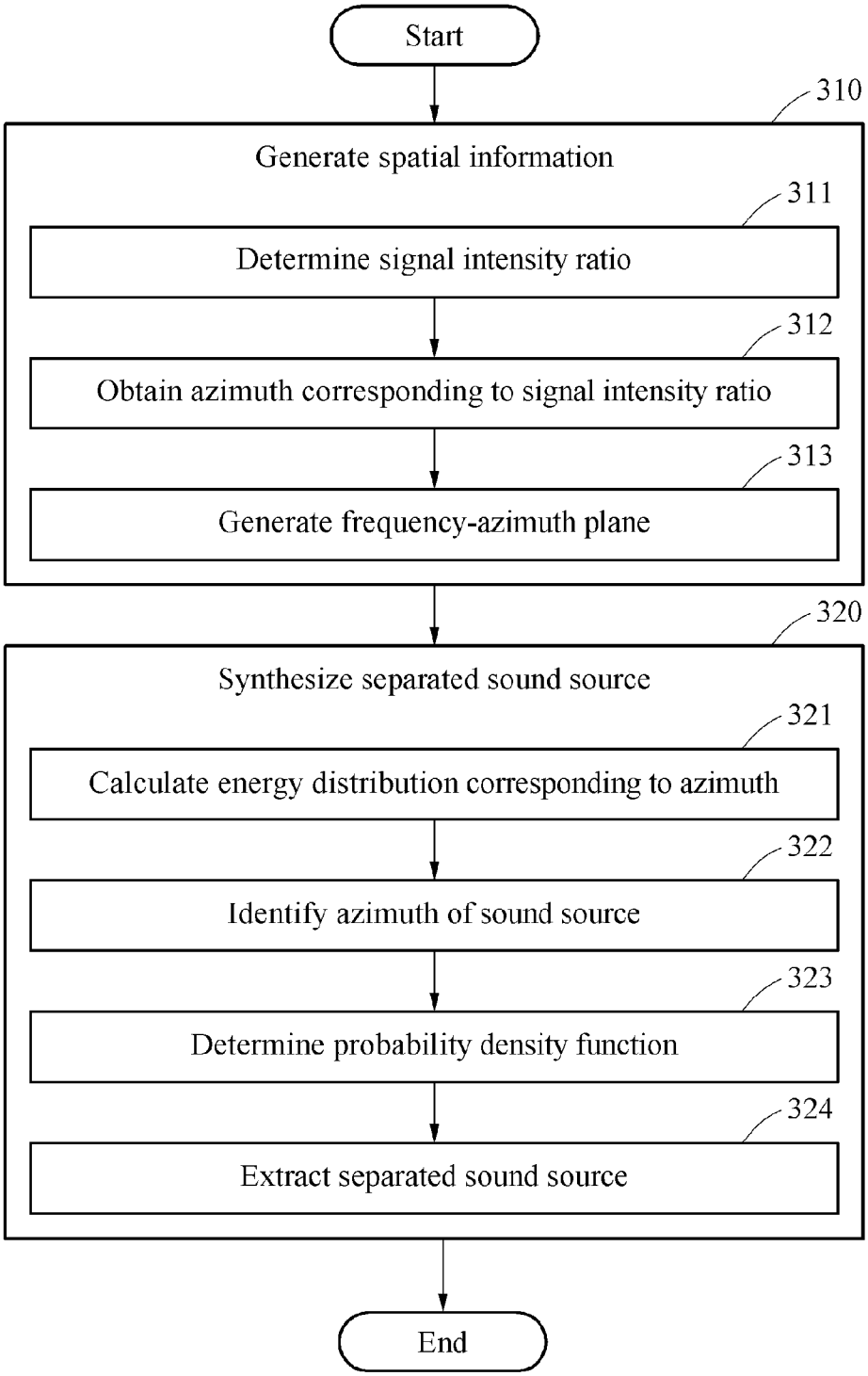
FIG. 3 is a flowchart illustrating a separated sound source synthesizing method performed by a separated sound source synthesizing apparatus according to an example embodiment.

FIG. 3 is a flowchart illustrating a separated sound source synthesizing method performed by a separated sound source synthesizing apparatus according to an example embodiment. In an example embodiment, there may be provided a non-transitory computer-readable storage medium including a program including instructions to cause a computer to perform the separated sound source synthesizing method. The separated sound source synthesizing apparatus may perform the separated sound source synthesizing method by reading the storage medium.

Referring to FIG. 3, in operation 310, the separated sound source synthesizing apparatus may generate spatial information associated with a sound source included in a frame of a stereo audio signal. The separated sound source synthesizing apparatus may transform the frame of the stereo audio signal into a frequency domain. In the frequency domain, the separated sound source synthesizing apparatus may combine a frequency component of a left channel signal and a frequency component of a right channel signal using g(i), as expressed by Equation 1. The left channel signal and the right channel signal may constitute the frame.

$$A_z(k, m, i) = \begin{cases} |X_2(k, m) - g(i)X_1(k, m)| & \text{if } i \le \beta/2 \\ |X_1(k, m) - g(i)X_2(k, m)| & \text{if } i > \beta/2 \end{cases} \quad \text{[Equation 1]}$$

In Equation 1, $X_1(k,m)$ denotes a k-th frequency component of a left channel signal of an m-th frame. $X_2(k,m)$ denotes a k-th frequency component of a right channel signal of the m-th frame. With respect to a frequency resolution N, k may satisfy $0 \le k \le N$. With respect to an azimuth resolution β, an azimuth index i may satisfy $0 \le i \le \beta$. Thus, the separated sound source synthesizing apparatus may generate an $(N+1)\times(\beta+1)$ frequency-azimuth plane from Equation 1.

g(i) of Equation 1 may be determined based on Equation 2.

$$g(i) = \begin{cases} \dfrac{i}{\beta} & \text{if } i \le \beta/2 \\ \dfrac{\beta - i}{\beta} & \text{if } i > \beta/2 \end{cases} \quad \text{[Equation 2]}$$

In Equation 2, g(i) may have a value ranging from "0" to "1". When comparing g(i) of a case in which a left channel signal of a sound source is dominant ($i \le \beta/2$) and g(i) of a case in which a right channel signal of the sound source is dominant ($i > \beta/2$), g(i) may have symmetry based on an azimuth of 90 degrees.

In operation 311, the separated sound source synthesizing apparatus may determine a signal intensity ratio $\bar{g}(i)$ of the frequency component of the left channel signal to the frequency component of the right channel signal with respect to a change in the azimuth based on a magnitude difference between the frequency component of the left channel signal and the frequency component of the right channel signal. The separated sound source synthesizing apparatus may determine the signal intensity ratio $\bar{g}(i)$ based on Equation 3.

$$\bar{g}(i) = \begin{cases} (1 - g(i)) \times (-1) & \text{if } i \le \beta/2 \\ 1 - g(i) & \text{if } i > \beta/2 \end{cases} \quad \text{[Equation 3]}$$

In Equation 3, the signal intensity ratio $\bar{g}(i)$ may be defined differently based on whether the left channel signal is dominant ($i \le \beta/2$) or the right channel signal is dominant ($i > \beta/2$). Thus, the signal intensity ratio $\bar{g}(i)$ may be determined based on the magnitude difference between the frequency component of the left channel signal and the frequency component of the right channel signal.

In comparison to Equation 2, the signal intensity ratio $\bar{g}(i)$ may have a different sign based on the azimuth of 90 degrees. Thus, whether the azimuth is less than 90 degrees or greater than 90 degrees may be verified based on the signal intensity ratio $\bar{g}(i)$. Unlike Equation 2, the signal intensity ratio $\bar{g}(i)$ may be used to distinguish between a left azimuth (a case of an azimuth being less than 90 degrees) and a right azimuth (a case of an azimuth being greater than 90 degrees).

In operation 312, the separated sound source synthesizing apparatus may obtain an azimuth corresponding to the signal intensity ratio $\bar{g}(i)$. The separated sound source synthesizing apparatus may obtain the azimuth based on Equation 4.

$$\text{azimuth}(i) = \begin{cases} \dfrac{360° \cdot \arctan(g(i))}{\pi} & \text{if } i \le \beta/2 \\ 180° \dfrac{360° \cdot \arctan(g(i))}{\pi} & \text{if } i > \beta/2 \end{cases} \quad \text{[Equation 4]}$$

Figure 4:
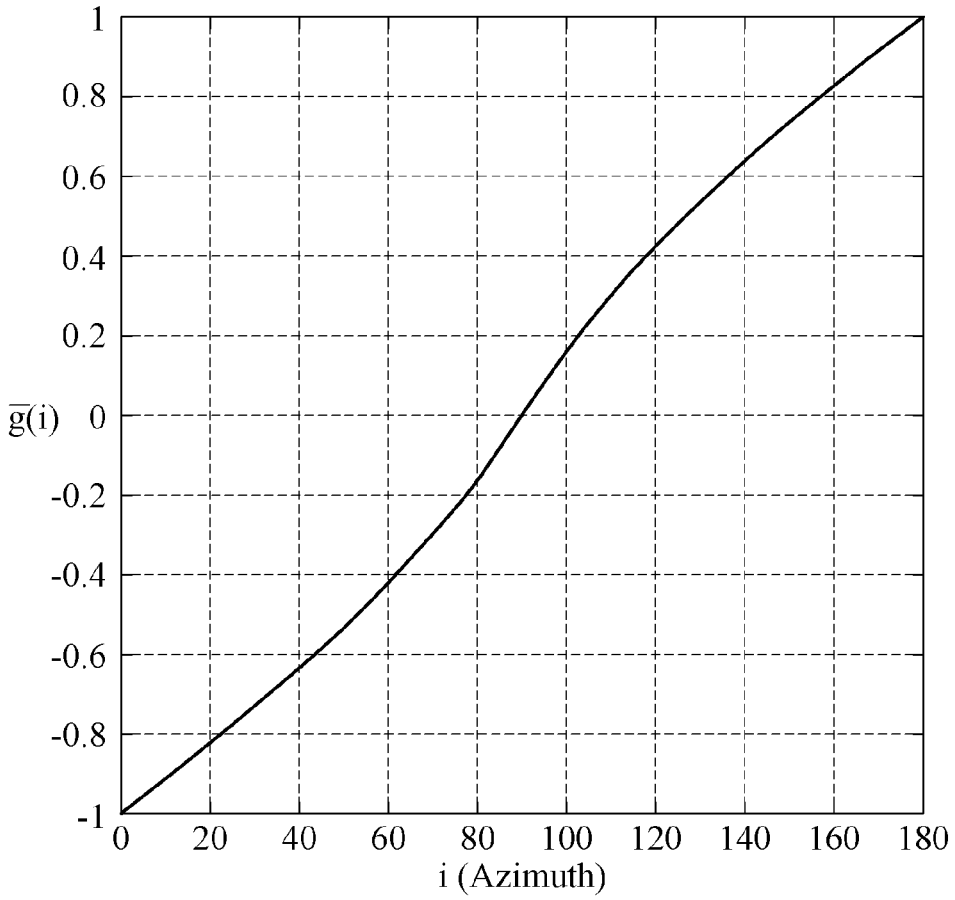
FIG. 4 is a graph illustrating a relationship between a signal intensity ratio and an azimuth according to an example embodiment.

FIG. 4 is a graph illustrating a relationship between a signal intensity ratio and an azimuth according to an example embodiment. Referring to FIG. 4, an azimuth and a signal intensity ratio calculated based on an azimuth index may have a non-linear relationship. Thus, when a frequency-azimuth plane is generated based on an azimuth index i, a separated sound source and the original sound source may differ from each other due to the non-linear relationship with the actual azimuth and the azimuth index i.

In operation 313, the separated sound source synthesizing apparatus may generate a frequency-azimuth plane by estimating an amount of energy of the sound source at an azimuth that minimizes the magnitude difference between the frequency component of the left channel signal and the frequency component of the right channel signal.

The separated sound source synthesizing apparatus may determine an azimuth index i that minimizes $A_z(k,m,i)$ of Equation 1. The separated sound source synthesizing apparatus may generate the frequency-azimuth plane by estimating an amount of energy of the sound source at the azimuth index i that minimizes $A_z(k,m,i)$ based on Equation 5.

$$A_z(k, m, i) = \begin{cases} A_z(k, m)_{max} - A_z(k, m)_{min} & \text{if } A_z(k, m, i) = A_z(k, m)_{min} \\ 0 & \text{otherwise} \end{cases} \quad \text{[Equation 5]}$$

The separated sound source synthesizing apparatus may generate $A_z(k, m, i)$ in a frequency-azimuth space with an axis of the azimuth of Equation 4. Since the frequency-azimuth plane is generated based on the actual azimuth, distortion resulting from the non-linear relationship with the actual azimuth and the azimuth index i may be removed. The separated sound source synthesizing apparatus may identify the azimuth of the sound source more accurately.

Figure 5:
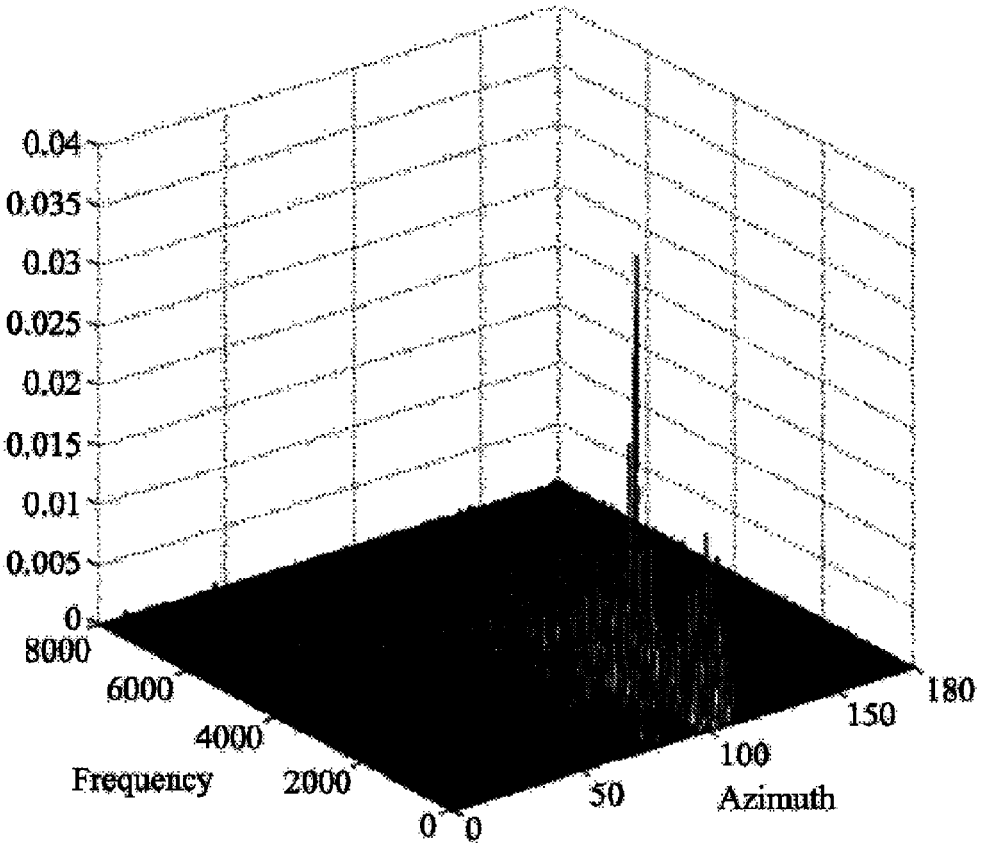
FIG. 5 illustrates an example of a frequency-azimuth plane generated by a separated sound source synthesizing apparatus according to an example embodiment.

FIG. 5 illustrates an example of a frequency-azimuth plane generated by a separated sound source synthesizing apparatus according to an example embodiment. Hereinafter, an operation of interpreting the frequency-azimuth plane by the separated sound source synthesizing apparatus will be described in detail with reference to FIGS. 3 and 5. It may be assumed that an azimuth of a sound source positioned on a left side corresponds to 0 degrees, an azimuth of a sound source positioned at a center corresponds to 90 degrees, and an azimuth of a sound source positioned on a right side corresponds to 180 degrees.

Referring to FIG. 5, energy of a frame of a stereo audio signal is concentrated around an azimuth of 100 degrees. Further, a frequency component less than or equal to 4 kilohertz (kHz) is dominant. The separated sound source synthesizing apparatus may identify the azimuth of the sound source by analyzing an energy distribution of the frequency-azimuth plane.

In operation 321, the separated sound source synthesizing apparatus may calculate the energy distribution of the frame of the stereo audio signal corresponding to the azimuth by accumulating an amount of energy of a frequency component for each azimuth in the frequency-azimuth plane. The separated sound source synthesizing apparatus may calculate the energy distribution of the frame corresponding to the azimuth by accumulating $A_z(k, m, i)$ for each azimuth.

In operation 322, the separated sound source synthesizing apparatus may identify an azimuth of the sound source by identifying the azimuth at which an amount of energy is at a local maximum in the energy distribution of the frame of the stereo audio signal corresponding to the azimuth. The energy distribution of the frame may have local maximum values. A number of the local maximum values may correspond to a number of sound sources mixed in the frame.

In the frequency-azimuth plane of FIG. 5, since the energy of the frame of the stereo audio signal is concentrated around the azimuth of 100 degrees, the energy distribution of the frame corresponding to the azimuth calculated by the separated sound source synthesizing apparatus may be at a local maximum at the azimuth of 100 degrees. Thus, the separated sound source synthesizing apparatus may identify the azimuth of the sound source as 100 degrees.

In operation 323, the separated sound source synthesizing apparatus may determine a probability density function based on a signal intensity ratio corresponding to the azimuth of the sound source. The probability density function may include a Gaussian window function. The separated sound source synthesizing apparatus may determine the Gaussian window function based on Equation 6.

$$G_j(k, m) = \frac{1}{\sqrt{2\pi\gamma}} r^{-(g(U(k))-g(d_j))^2/(2\gamma)} \quad \text{[Equation 6]}$$

In Equation 6, $d_j$ denotes the azimuth of the sound source identified in operation 322 by the separated sound source synthesizing apparatus. Thus, an axis of symmetry of the Gaussian window function may be determined based on the signal intensity ratio $\overline{g}(d_j)$ corresponding to the azimuth of the sound source. $\gamma$ may be used to determine a width of the Gaussian window function. The separated sound source synthesizing apparatus may adjust $\gamma$, thereby adjusting distortion caused by a sound source positioned at a different azimuth. U(k) may be defined with respect to an azimuth index i that minimizes $A_z(k,m,i)$ in a k-th frequency component, as expressed by Equation 7.

$$U(k) = \underset{0 \le i \le \beta}{\arg\min} A_z(k, m, i) \quad \text{[Equation 7]}$$

In operation 324, the separated sound source synthesizing apparatus may extract the separated frequency-domain sound source by applying the determined probability density function to a dominant signal between the left channel signal and the right channel signal of the frame of the stereo audio signal. The separated sound source synthesizing apparatus may extract a k-th frequency component $S_j(k,m)$ of a separated sound source $S_j$ of the m-th frame, based on Equation 8.

$$S_j(k, m) = \begin{cases} G_j(k, m) \cdot X_1(k, m) \text{ if } d_j \le \beta/2 \\ G_j(k, m) \cdot X_2(k, m) \text{ if } d_j > \beta/2 \end{cases} \quad \text{[Equation 8]}$$

In Equation 8, the k-th frequency component $S_j(k,m)$ of the separated sound source $S_j$ may be extracted by applying the probability density function to the dominant signal between the frequency component of the left channel signal and the frequency component of the right channel signal. Since the azimuth of the sound source corresponds to 100 degrees in the example of FIG. 5, the separated sound source synthesizing apparatus may extract the separated frequency-domain sound source by applying the Gaussian window function to the right channel signal with reference to Equation 8.

The separated sound source synthesizing apparatus may transform the separated frequency-domain sound source into a separated time-domain sound source. In detail, the separated sound source synthesizing apparatus may transform the k-th frequency component $S_j(k,m)$ of the separated sound source $S_j$ into a time domain. Further, the separated sound source synthesizing apparatus may synthesize the separated sound source using an overlap-add technique.

Hereinafter, a comparison between a sound source and a separated sound source synthesized by the separated sound source synthesizing apparatus from a stereo audio signal provided in a stereo audio source separation evaluation campaign (SASSEC) will be described.

The stereo audio signal provided in the SASSEC may include mixed voices of four different users output from speakers positioned in a 1-meter (m) radius at four azimuths of 45 degrees, 75 degrees, 100 degrees, and 140 degrees using two non-directional microphones, for example, at a spacing distance of 5 cm. The stereo audio signal provided in the SAS SEC may include four mixed sound sources positioned at the four azimuths of 45 degrees, 75 degrees, 100 degrees, and 140 degrees, respectively.

Figure 6:
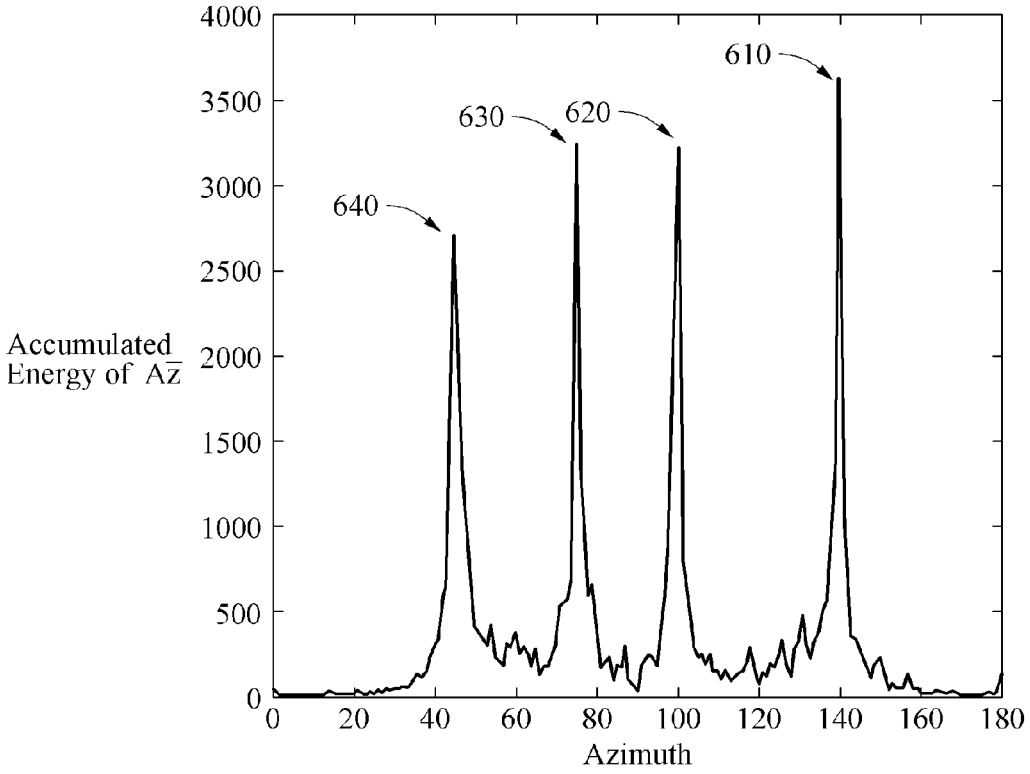
FIG. 6 is a graph illustrating an energy distribution of a frame of a stereo audio signal corresponding to an azimuth calculated by a separated sound source synthesizing apparatus according to an example embodiment.

FIG. 6 is a graph illustrating an energy distribution of a frame of a stereo audio signal corresponding to an azimuth calculated by a separated sound source synthesizing apparatus according to an example embodiment. The separated sound source synthesizing apparatus may calculate the energy distribution of the stereo audio signal corresponding to the azimuth by accumulating an amount of energy of a frequency component for each azimuth in a frequency-azimuth plane.

Referring to FIG. 6, the accumulated energy may have local maximum values 610, 620, 630, and 640 around azimuths of 45 degrees, 75 degrees, 100 degrees, and 140 degrees, respectively. The separated sound source synthesizing apparatus may determine a probability density function for each sound source based on a signal intensity ratio corresponding to the azimuth of each of the local maximum values 610, 620, 630, and 640.

The separated sound source synthesizing apparatus may extract a separated sound source by applying the probability density function to a dominant signal between a left channel signal and a right channel signal of the stereo audio signal. For example, when synthesizing separated sound sources corresponding to the local maximum values 620 and 610, the separated sound source synthesizing apparatus may apply a Gaussian window function to the right channel signal since the local maximum values 620 and 610 are positioned at azimuths of 100 degrees and 140 degrees which are greater than an azimuth of 90 degrees.

Figure 7:
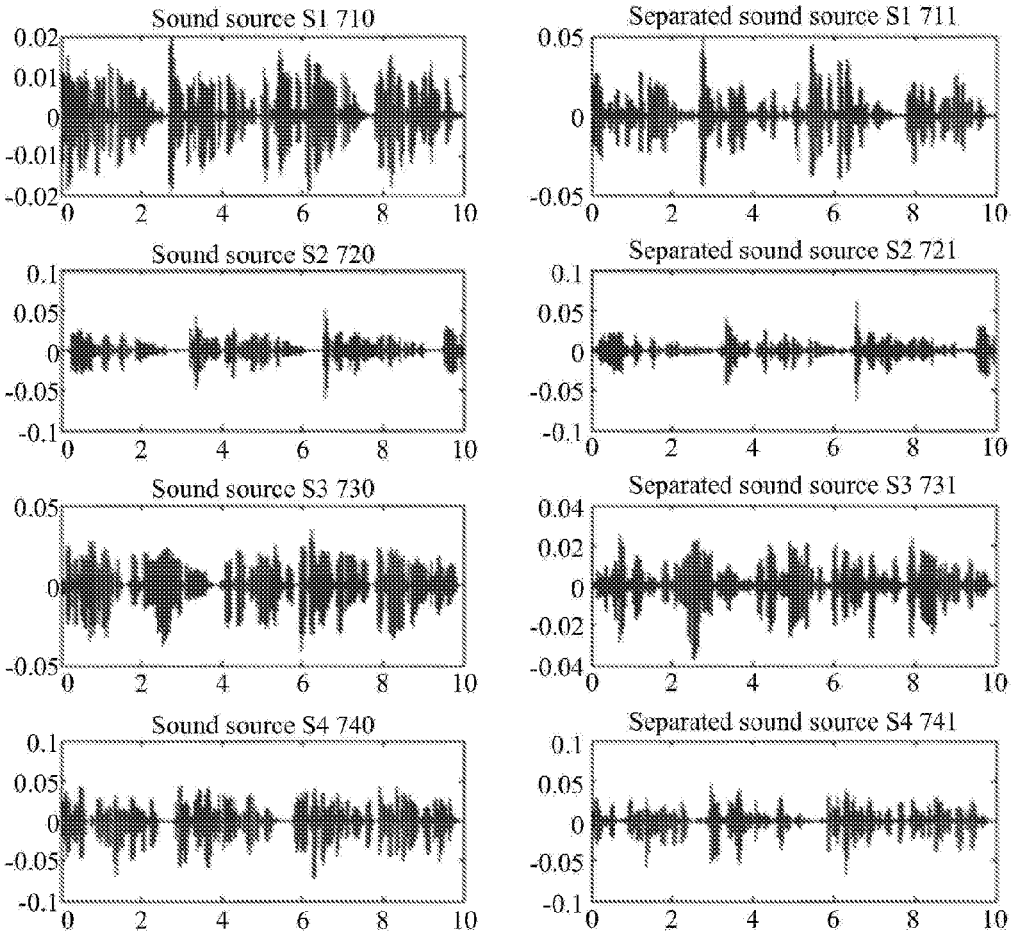
FIG. 7 illustrates a comparison between waveforms of sound sources and waveforms of separated sound sources synthesized by a separated sound source synthesizing apparatus according to an example embodiment.

FIG. 7 illustrates a comparison between waveforms of sound sources and waveforms of separated sound sources synthesized by a separated sound source synthesizing apparatus according to an example embodiment. Referring to FIG. 7, a separated sound source 711 with respect to a sound source S1 710, a separated sound source 721 with respect to a sound source S2 720, a separated sound source 731 with respect to a sound source S3 730, and a separated sound source 741 with respect to a sound source S4 740 are illustrated.

Table 1 shows a comparison of performances between a separated sound source synthesized by the separated sound source synthesizing apparatus and a separated sound source synthesized by a related art of synthesizing a separated sound source. In Table 1, the performances are compared by calculating source to distortion ratios (SDRs), source to interference ratios (SIRs), and source to artifact ratios (SARs) thereof.

TABLE 1

| | SDR (dB) | SIR (dB) | SAR (dB) |
|---|---|---|---|
| Related art | −2.89 | 19.07 | −2.80 |
| Present disclosure | 6.21 | 20.52 | 6.43 |

Referring to Table 1, the performance of the separated sound source synthesized by the separated sound source synthesizing apparatus improved by about 9.1 decibels (dB) in SDR, about 1.45 dB in SIR, and about 9.23 dB in SAR.

The components described in the exemplary embodiments of the present invention may be achieved by hardware components including at least one DSP (Digital Signal Processor), a processor, a controller, an ASIC (Application Specific Integrated Circuit), a programmable logic element such as an FPGA (Field Programmable Gate Array), other electronic devices, and combinations thereof. At least some of the functions or the processes described in the exemplary embodiments of the present invention may be achieved by software, and the software may be recorded on a recording medium. The components, the functions, and the processes described in the exemplary embodiments of the present invention may be achieved by a combination of hardware and software.

The units and/or modules described herein may be implemented using hardware components and software components. For example, the hardware components may include microphones, amplifiers, band-pass filters, audio to digital convertors, and processing devices. A processing device may be implemented using one or more hardware device configured to carry out and/or execute program code by performing arithmetical, logical, and input/output operations. The processing device(s) may include a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such as parallel processors.

The software may include a computer program, a piece of code, an instruction, or some combination thereof, to independently or collectively instruct and/or configure the processing device to operate as desired, thereby transforming the processing device into a special purpose processor. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums.

The methods according to the above-described embodiments may be recorded in non-transitory computer-readable media including program instructions to implement various operations of the above-described embodiments. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

A number of embodiments have been described above. Nevertheless, it should be understood that various modifications may be made to these embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claim.

What is claimed is:

1. A separated sound source synthesizing method comprising:

generating spatial information associated with a sound source included in a frame of a stereo audio signal, wherein the spatial information comprises a frequency-azimuth plane, which represents an energy distribution corresponding to a frequency and an azimuth of the frame of the stereo audio signal; and synthesizing a separated frequency-domain sound source from the frame of the stereo audio signal based on the spatial information and a probability density function which is determined based on the energy distribution.

2. The separated sound source synthesizing method of claim 1, wherein the generating comprises:

determining a signal intensity ratio of a frequency component of a left channel signal to a frequency component of a right channel signal based on a magnitude difference between the frequency component of the left channel signal and the frequency component of the right channel signal, the left channel signal and the right channel signal constituting the frame of the stereo audio signal;

obtaining an azimuth corresponding to the signal intensity ratio; and generating the frequency-azimuth plane by estimating an amount of energy of the sound source at the azimuth that minimizes the magnitude difference between the frequency component of the left channel signal and the frequency component of the right channel signal.

3. The separated sound source synthesizing method of claim 1, wherein the synthesizing comprises:

calculating the energy distribution of the frame of the stereo audio signal corresponding to the azimuth by accumulating an amount of energy of a frequency component for each azimuth in the frequency-azimuth plane;

identifying an azimuth of the sound source by identifying the azimuth at which an amount of energy is at a local maximum in the energy distribution of the frame of the stereo audio signal corresponding to the azimuth;

determining the probability density function based on a signal intensity ratio corresponding to the azimuth of the sound source; and extracting the separated frequency-domain sound source by applying the probability density function to a dominant signal between a left channel signal and a right channel signal constituting the frame of the stereo audio signal.

4. The separated sound source synthesizing method of claim 3, wherein the probability density function is a Gaussian window function, and an axis of symmetry of the Gaussian window function is determined based on the azimuth of the sound source.

5. The separated sound source synthesizing method of claim 1, wherein the synthesizing comprises transforming the separated frequency-domain sound source into a separated time-domain sound source, and applying an overlap-add technique to the separated time-domain sound source.

6. A frequency-azimuth plane generating method comprising:

determining a signal intensity ratio of a frequency component of a left channel signal to a frequency component of a right channel signal based on a magnitude difference between the frequency component of the left channel signal and the frequency component of the right channel signal, the left channel signal and the right channel signal constituting a frame of a stereo audio signal;

obtaining an azimuth corresponding to the signal intensity ratio of the frequency component;

generating a frequency-azimuth plane by estimating an amount of energy of a sound source included in the stereo audio signal at the azimuth that minimizes the magnitude difference between the frequency component of the left channel signal and the frequency component of the right channel signal;

calculating an energy distribution corresponding to a frequency and an azimuth of the frame of the stereo audio signal by accumulating an amount of energy of a frequency component for each azimuth in the frequency-azimuth plane;

identifying an azimuth of the sound source by identifying an azimuth at which an amount of energy is at a local maximum in the energy distribution corresponding to the frequency and the azimuth of the frame of the stereo audio signal; and determining a probability density function based on a signal intensity ratio corresponding to the azimuth of the sound source.

7. The frequency-azimuth plane generating method of claim 6, wherein a number of the azimuths corresponds to a number of sound sources.

8. A separated sound source synthesizing apparatus comprising:

a spatial information generator configured to generate spatial information associated with a sound source included in a frame of a stereo audio signal, wherein the spatial information comprises a frequency-azimuth plane, which represents an energy distribution corresponding to a frequency and an azimuth of the frame of the stereo audio signal; and a separated sound source synthesizer configured to synthesize a separated frequency-domain sound source from the frame of the stereo audio signal based on the spatial information and a probability density function which is determined based on the energy distribution.

* * * * *